United States Patent [19]

Haynie

[11] 4,449,368

[45] May 22, 1984

[54] APPARATUS AND METHODS OF COOLING AND CONDENSING EXHAUST STEAM FROM A POWER PLANT

[75] Inventor: Timothy J. Haynie, Lockport, Ill.

[73] Assignee: Chicago Bridge & Iron Company, Oak Brook, Ill.

[21] Appl. No.: 490,536

[22] Filed: May 2, 1983

[51] Int. Cl.[3] ..... F01K 9/00

[52] U.S. Cl. ..... 60/652; 60/688; 60/659; 60/692

[58] Field of Search ..... 60/652, 659, 692, 693, 60/688, 689

[56] References Cited

U.S. PATENT DOCUMENTS

| | | | |
|---|---|---|---|
| 3,681,920 | 8/1972 | Margen | 60/652 |
| 3,851,702 | 12/1974 | Heller et al. | 60/692 X |
| 4,270,358 | 6/1981 | Husain et al. | 60/693 |
| 4,315,404 | 2/1982 | Schmitt et al. | 60/692 X |

*Primary Examiner*—Allen M. Ostrager

*Attorney, Agent, or Firm*—Merriam, Marshall & Bicknell

[57] ABSTRACT

Apparatus and methods of cooling and condensing exhaust steam from a power plant which rejects heat to air and uses a peak shaving water based cooling system to supplement a primary cooling system. During regeneration of the cooling water, which is heated during peak shaving, the hot water is fed directly to the boiler.

6 Claims, 4 Drawing Figures

APPARATUS AND METHODS OF COOLING AND CONDENSING EXHAUST STEAM FROM A POWER PLANT

This invention is concerned with apparatus and methods of cooling and condensing exhaust steam from an industrial power plant which rejects heat to ambient air either directly in an air cooled steam condenser or indirectly through the use of an intermediate heat transfer fluid and an air cooled heat exchanger, during hot periods uses a peak-shaving water based cooling system to supplement the primary cooling system and, during regeneration of the cooling water which is heated during peak shaving, feeds the hot water directly to the boiler.

BACKGROUND OF THE INVENTION

Many commercial and industrial processes generate large amounts of waste heat which must be removed for successful operation. The waste heat is often carried in the form of a hot fluid stream. For a number of reasons, it is often undesirable or impermissible for the hot fluid stream to be disposed of, so it must be cooled and reused. One such hot fluid stream is exhaust steam, such as from an electric power generating steam turbine, which is condensed to water which then is reconverted to steam in a boiler to be used again in powering the turbine.

A base or primary cooling system of one type or another is provided for cooling the hot exhaust steam. All such systems rely, ultimately, on heat rejection to the environment, either by direct rejection or indirectly through an intermediate fluid, to air or to water from a river, lake or sea.

A typical cooling system can be illustrated further by reference to a power generating plant. In the production of electric power, heat is first produced by nuclear energy or combustion of a fossil fuel such as oil, gas or coal. The heat produced is then used to convert water into steam. The steam is conducted at high pressure to a turbine which it drives. The turbine is, of course, coupled to a generator which produces electric power. The spent steam from the turbine is condensed by the cooling system and then the water is recycled and reheated to steam again.

An air-cooled system is generally designed and built to provide a cooling capacity or duty adequate for the intended purpose on the hottest day, or ambient temperature, anticipated at the site of the plant involved. This results in an excess cooling capacity for all but a small number of days out of a year. Even on the hottest days, the maximum cooling capacity of the system often is not utilized except during the very warmest part of the day. The cooling system installation, operation and maintenance involve large costs and expenses which cover a system that is not fully employed, regardless of the hot fluid stream to be cooled.

Various dry-type cooling systems have been proposed. In one such system, the refrigerant ammonia is used in a closed loop cycle to absorb heat in the steam condenser of a power generating plant and then reject heat in a cooling tower where air absorbs the heat from the ammonia coolant. Such a system would require a very large cooling tower investment to provide adequate cooling capacity on very hot days or period of days. This would entail a high capital investment. To reduce this cost, it has been proposed in Husain et al U.S. Pat. No. 4,270,358 to reduce the size of the cooling tower and to provide a peak-shaving cooling system using water as the coolant. Cold water would constitute the peak-shaving coolant and once heated the hot water would be stored until it could be cooled when excess cooling tower capacity became available, such as at nighttime when the air temperature would be lower and electric power demand decreases.

At the present time the 330 MW Wyodak Power Plant at Gillette, Wyoming employs a direct condensing cooling system. The exhaust steam is sent directly to a steam condensing system 164 feet wide and 360 feet long utilizing sixty-six 22-foot diameter fans and three 33-foot diameter fans. Each fan is driven by a two-speed motor. Two sets of vacuum steam ducts, each 13 feet 6 inches in diameter, are used to carry the steam from the turbine exhaust to the A-frame forced draft air cooled condensing coils.

The direct condensing method of cooling exhaust steam involves a low initial capital cost; but a plant using it suffers a penalty at high ambient temperatures because the turbine back pressure increases, thereby reducing the total power generating capacity of the plant. A peak shaving cooling system based on water, such as disclosed in Husain et al U.S. Pat. No. 4,270,358, could be utilized in the Wyodak Power Plant. However, a peak shaving system as disclosed in that patent during regeneration cools all of the hot water produced in peak shaving so that the water can be used later in peak shaving. While such a system is highly useful, it can be improved and its efficiency increased.

SUMMARY OF THE INVENTION

According to one aspect of the subject invention there is provided a method of operating a steam driven turbine comprising conveying a stream of the exhaust steam from the turbine to a primary cooling means to condense the steam and feeding the resulting condensate to a boiler for conversion to steam to drive the turbine so long as the heat rejection capacity of the primary cooling means is adequate to condense all of the steam; supplementing the cooling capacity of the primary cooling means, when it provides inadequate cooling to condense all of the steam, by peak shaving cooling by contemporaneously also withdrawing boiler quality cold cooling water from a cold water reservoir and feeding the cold cooling water into the exhaust steam to thereby condense a sufficient portion of the steam to water such that the remaining portion of the steam is condensed to water by the primary cooling means; feeding part of the hot condensed water, from the primary cooling and the peak shaving cooling, directly to the boiler used to produce the steam which drives the turbine, and part of the hot condensed water to a hot water reservoir, during such times as the cooling capacity of the primary cooling means is supplemented as described; and when the cooling capacity of the primary cooling means has excess cooling capacity to condense steam, feeding cold condensed water from the primary cooling means to the cold water reservoir, and withdrawing hot water from the hot water reservoir and feeding it hot to the boiler.

The described method is especially useful when the primary cooling means condenses the steam by heat rejection to ambient air, such as in a mechanical draft or natural draft air cooled steam condenser or cooling tower.

It is also feasible, when the primary cooling means has excess cooling capacity, to withdraw hot water from the hot water reservoir and feed it directly into the exhaust steam since the low pressure of the steam will result in flashing of some of the hot water into steam with production of cold water which can be removed and sent to cold water storage for later use in peak shaving.

The method of the invention leads to a highly efficient operation because it feeds hot peak shaving water to the boiler during regeneration of the cold peak shaving water. This reduces the amount of heat which must be supplied to the boiler to produce steam from the water since it is already hot when put into the boiler feed stream.

According to a second aspect of the invention, there is provided apparatus comprising a steam driven turbine; means for conveying a stream of exhaust steam from the turbine to a primary cooling means to condense the steam; means for feeding the condensate to a boiler for conversion to steam to drive the turbine so long as the heat rejection capacity of the primary cooling means is adequate to condense the steam; means for supplementing the cooling capacity of the primary cooling means, when it provides inadequate cooling to condense the steam, by peak shaving cooling, including means for contemporaneously also withdrawing boiler quality cold cooling water from a cold water reservoir and feeding the cooling water into the exhaust steam to thereby condense a sufficient portion of the steam to water such that the remaining portion of the steam is condensed to water by the primary cooling means; means for feeding part of the hot condensed water, from the primary cooling and the peak shaving cooling, directly to the boiler, used to produce the steam which drives the turbine, and part of the hot condensed water to a hot water reservoir, during such times as the cooling capacity of the primary cooling means is supplemented as described; and means for feeding cold condensed water from the primary cooling means to the cold water reservoir, and withdrawing hot water from the hot water reservoir and feeding it hot to the boiler, when the cooling capacity of the primary cooling means has excess cooling capacity to condense steam.

The primary cooling means in the apparatus can be a mechanical draft or natural draft air cooled steam condenser or cooling tower.

The apparatus can also include means to withdraw hot water from the hot water reservoir, when the primary cooling means has excess cooling capacity, and feed it directly into the exhaust steam so that the low pressure of the steam will result in flashing of some of the hot water into steam with production of cold water which can be removed, and means to withdraw the said cold water and feed it to the cold water reservoir.

DETAILED DESCRIPTION OF THE DRAWINGS

To the extent it is reasonable and practical, the same or similar elements or parts appearing in the various views of the drawings will be identified by the same numbers.

Figure 1:
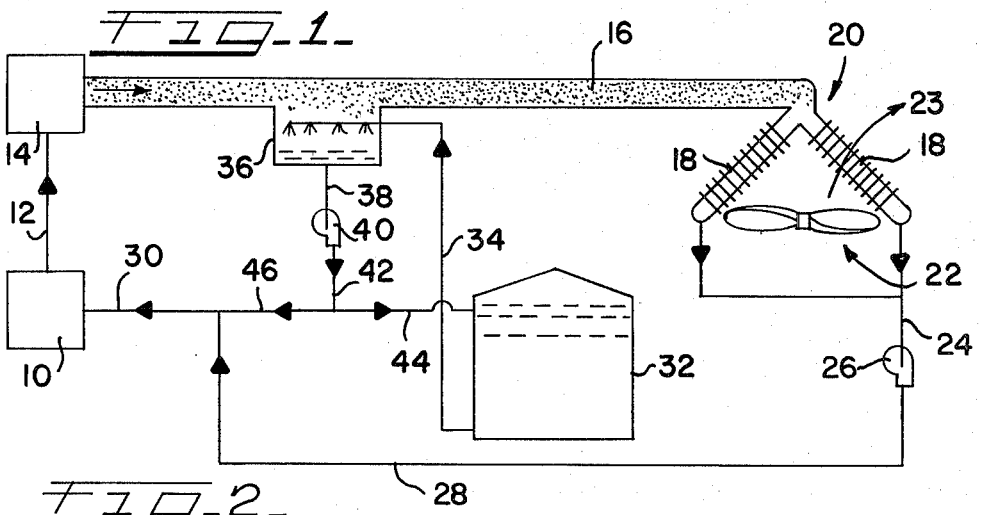
FIG. 1 illustrates one combination of novel apparatus according to the invention and which can be used in practicing the method of the invention with respect to normal power generation operation and with peak shaving cooling.

With reference to FIG. 1, boiler 10 generates high pressure steam which is fed by conduit 12 to turbine 14 which drives a generator, not shown. The exhaust or spent steam is fed from turbine 14 to conduit 16 which delivers it to heat exchanger 18 in mechanical draft condenser 20. Air 22 at atmospheric or ambient temperature enters the bottom of the condenser 20, becomes heated, and flows upwardly through and out of the condenser as heated air 23.

All of the exhaust steam in normal operation is condensed in the condenser 20 when the air temperature is sufficiently low. The condenser 20, however, is sized to provide inadequate cooling capacity when the air temperature exceeds a predetermined design temperature. In normal operation the steam condensate is withdrawn as hot water from the heat exchanger 18 through conduit 24 which feeds it to pump 26. The hot water from pump 26 is fed to conduit 28 which feeds it to conduit 30 which delivers it hot to boiler 10.

When the cooling capacity of condenser 20 is unable to condense all the steam because the atmospheric air temperature is above that for which the condenser cooling capacity was designed, continued optimum operation of the generating system requires the use of a peak shaving cooling system to condense excess steam which cannot be handled by condenser 20. Accordingly, a reservoir tank 32 is provided for holding only cold water, only hot water, or stratified layers of hot and cold water. To effect peak shaving, boiler quality cold water is removed from the bottom part of tank 32 by conduit 34 and sprayed into steam box 36 to condense the excess steam not condensible in condenser 20 during periods when the air is above a predetermined temperature. The hot water is removed from steam box 36 through conduit 38 and fed to pump 40. The hot water is fed from pump 40 to conduit 42. Some of the hot water is fed from conduit 42 to conduit 46 which feeds it to conduit 30 for delivery hot to boiler 30. Most of the hot water is fed from conduit 42 to conduit 44 which delivers it to the top part of tank 32 to be stored for subsequent regeneration or cooling.

Figure 2:
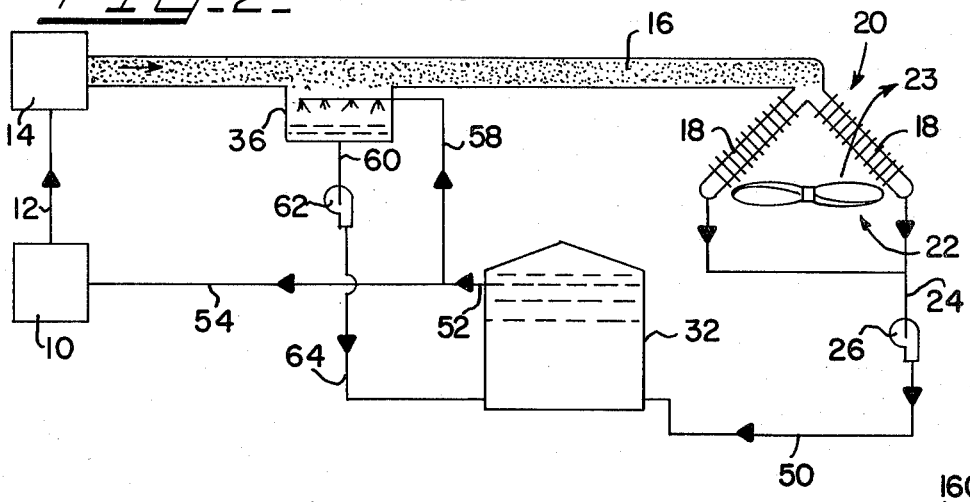
FIG. 2 illustrates the apparatus of FIG. 1 as modified and supplemented for regeneration of the hot peak shaving cooling water.

During evening or nighttime hours when the air temperature normally drops, the apparatus described in conjunction with FIG. 1 will have excess cooling capacity, even without use of peak shaving cooling. Accordingly, the hot water produced and stored in tank 32 during peak shaving can be regenerated by use of an apparatus arrangement as shown in FIG. 2.

In the evening when the air is cool the condensed cold water from condenser 20 is fed by pump 26 to conduit 50 which feeds it to the lower part of tank 32. While this is taking place, hot water is withdrawn from the upper part of tank 32 through conduit 52 and fed to conduit 54 which feeds it hot to boiler 10. In this way the heat required to convert the water to steam is reduced by eliminating the need to first heat cold water to a hot water temperature.

If all the hot water in the tank need not be fed to the boiler, some of the hot water withdrawn by conduit 52 can be fed to conduit 58 and be sprayed or injected into steam box 36. The hot water upon entry into the low vacuum state in the steam box is partially flashed thereby forming residual cold water. This cold water is removed by conduit 60, fed to pump 62 and then delivered to conduit 64 for transport to the lower part of tank 32 for storage.

By following the described regeneration system all of the water in tank 32 can be cooled during the evening or nighttime following daytime use of the cold water for peak shaving cooling.

Figure 3:
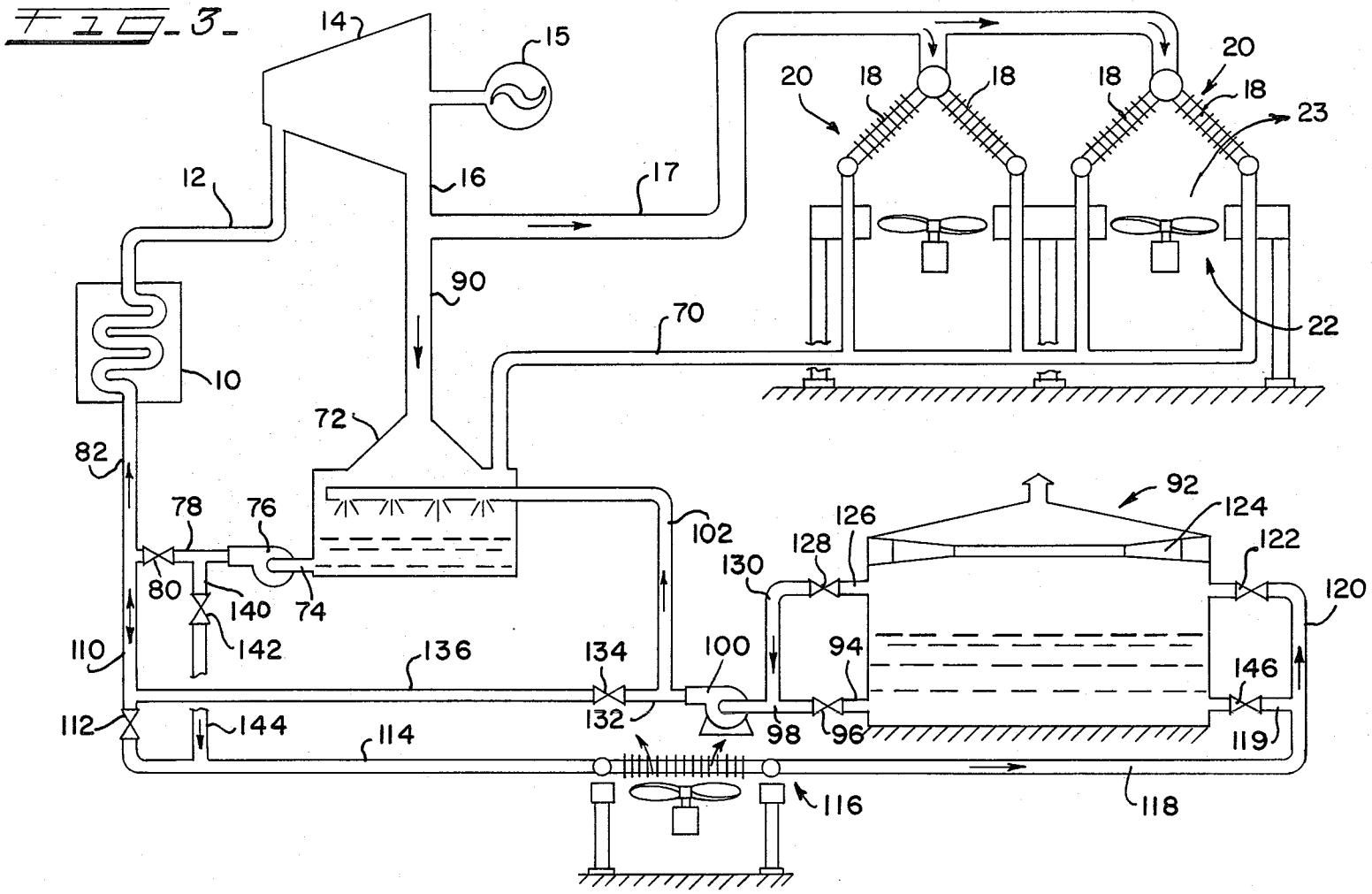
FIG. 3 illustrates diagrammatically a novel combination of apparatus useful for power generation which includes a primary cooling system, a peak shaving cooling system and a system for regenerating the peak shaving coolant.

Turning now to FIG. 3, high pressure steam is produced in boiler 10 and fed by conduit 12 to steam driven turbine 14 which is operatively connected to electric generator 15. All the exhaust steam from the turbine 14 is fed by conduit 16 to two forced draft cooling towers 20 which contain heat exchangers 18.

Steam condenser 20 is designed and sized to be able to condense all the exhaust steam from turbine 14 by indirect heat rejection up to a predetermined ambient air temperature, such as about 80° to 90° F.

The condensed boiler water is withdrawn from the steam condenser 20 through conduit 70 and fed to steam box 72. The hot water is withdrawn from steam box 72 through conduit 74 and fed to pump 76 which delivers it under high pressure to conduit 78. The water flows from conduit 78 through valve 80 to conduit 82 which feeds it to boiler 10.

The described operation of the plant will continue throughout most of the year. However, during the summer and on other hot days of the year when the ambient or atmospheric air temperature is above the predetermined temperature limiting the cooling capacity of the steam condensers 20, it is necessary to employ peak-shaving cooling to prevent the exhaust steam back pressure becoming high, such as 10 to 15 inches of mercury, because this reduces the amount of electricity that can be generated and thus is a penalty to the plant.

On hot days when the cooling tower capacity is inadequate, a part of the exhaust steam stream from the turbine is diverted to conduit 90 which feeds it to the steam box 72. Cold water is removed from the lower part of storage tank 92 through conduit 94, valve 96 now being open, and is fed to conduit 98 which delivers it to pump 100. From pump 100 the cold water is fed to conduit 102 which feeds it to the steam box 72. The cold water condenses the steam to water which accumulates at the bottom of the steam box 72. The boiler quality hot water is removed from the steam box 72 and fed to pump 76 which feeds it to conduit 82. From conduit 82 the hot water flows to the boiler for reconversion to steam.

Any part of the hot water which is not needed for boiler feed can be diverted after exiting valve 80 into conduit 110, fed through valve 112 now open, into conduit 114, and fed through air cooled chiller 116, while not operating, into conduit 118. The water, still hot, is fed from conduit 118 to conduit 120, through valve 122 into the upper part of tank 92. Floating roof 124 floats on the water in tank 92.

During the nighttime, when there is excess cooling capacity to condense all the exhaust steam without peak shaving cooling with cold water removed from tank 92, the hot water in that tank can be regenerated into cold cooling water for later use in peak shaving. In the nighttime, the hot water in tank 92 is withdrawn through conduit 126, fed through open valve 128 to conduit 130 and on to pump 100. Valve 96 is closed. From pump 100 the hot water is fed to conduit 132, through valve 134 and to conduit 136 which delivers it to conduit 110 with valve 112 closed. From conduit 110 the hot water flows to conduit 82 for delivery to boiler 10 where it is converted to steam. By use of the described system, the hot water need not be cooled in the regeneration phase before it is used in steam production. After conversion to steam and its use in driving the turbine 14, the exhaust steam is fed through the steam condensers 20. The resulting cold condensate water is withdrawn from the condensers by conduit 70 and fed to steam box 72. This cold water can be removed through conduit 74 and fed to pump 76. With valve 80 closed, pump 76 delivers the cold water to conduit 140 which feeds it through valve 142 now open to conduit 144. Conduit 114 receives the cold water from conduit 144 and feeds it through air cooled chiller 116, now operating, to conduit 118. With valve 122 closed, conduit 118 feeds the cold water through conduit 119 and valve 146, now open, into the lower part of tank 92.

When hot water is removed from tank 92 through conduit 126 during the regeneration operation, some of that water can be diverted, after leaving pump 100, into conduit 102 for injection or spraying into steam box 72. The hot water, upon being subjected to the high vacuum in the steam box, is partially flashed and thereby cooled. The cold water can then be withdrawn through conduit 74 and, with valve 80 closed, fed to conduit 144 and ultimately through valve 146 into the lower and cold part of the tank.

Figure 4:
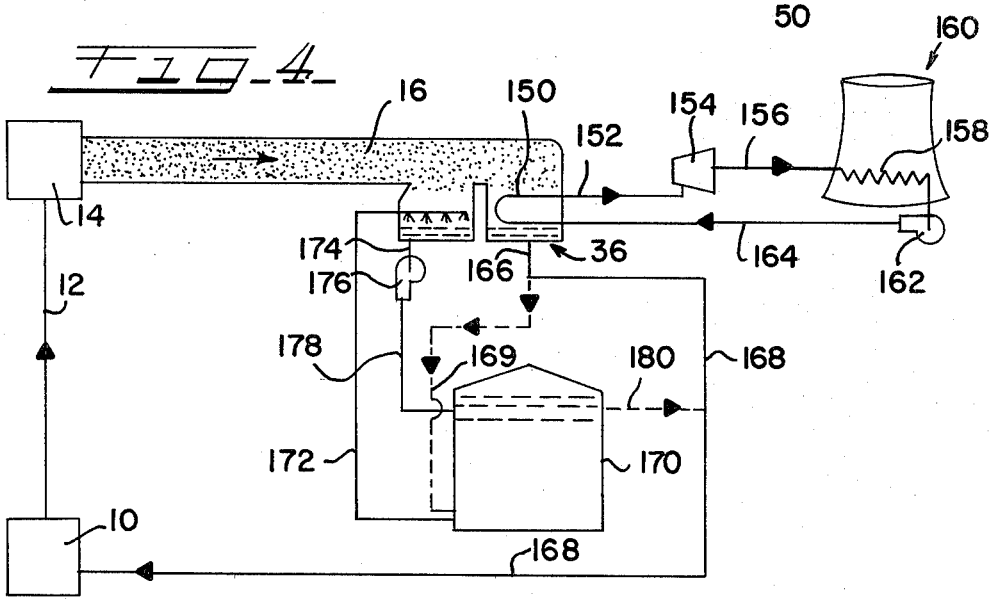
FIG. 4 illustrates diagrammatically a novel combination of apparatus useful for power generation which includes an indirect primary cooling system which employs a refrigerant, a peak shaving cooling system and a system for regenerating the peak shaving coolant.

FIG. 4 illustrates another embodiment of the invention in which the primary cooling is effected in an indirect manner using a refrigeration loop. In normal operation, exhaust steam from turbine 14 is fed by conduit 16 to steam box 36 in which it is condensed indirectly by heat exchange to a liquefied refrigerant which flows through heat exchanger 150. The liquid refrigerant, which is thereby vaporized, is fed by conduit 152 to compressor 154. The pressurized refrigerant gas is fed from compressor 154 to conduit 156 which feeds it to heat exchanger 158 in cooling tower 160. Upward flow of air through the cooling tower cools the refrigerant to a liquid which is then withdrawn and, by means of pump 162, it is fed to conduit 164 which delivers it to heat exchanger 150.

The condenser water is removed from steam box 36 through conduit 166 which feeds it relatively hot to conduit 168 which then feeds it hot to boiler 10. By returning the water as hot as possible to the boiler less heat must be supplied by the boiler to convert it to steam, thereby reducing energy consumption.

The described primary cooling system, to minimize capital investment, is sized so as to effect condensation of all the exhaust steam up to a predetermined atmospheric air temperature, which usually will be in the range of 80° to 90° F. When the air temperature rises above such temperature, such as during summer daytime, the primary cooling means must be supplemented by the peak shaving cooling means integrated into the system.

Peak shaving cooling is effected by withdrawing boiler quality cold water from the lower part of tank 170 by conduit 172 and spraying or injecting it into steam box 36 to condense steam. The resulting hot water is withdrawn through conduit 174 and fed to pump 176. Conduit 178 delivers the hot water from pump 176 to the upper part of tank 170 for storage. Peak shaving cooling continues in this manner so long as needed.

At nighttime, when the primary cooling system has excess cooling capacity above that needed to condense all the steam, the hot water in tank 170 can be regenerated or cooled. Thus, hot water is withdrawn from the upper part of tank 170 by means of conduit 180 and fed to conduit 168 for delivery hot to the boiler 10. After conversion to steam and use in the turbine 14 the exhaust steam is condensed to cold water in steam box 36 by heat exchange with liquid refrigerant flowing through heat exchanger 150. The cold water is then removed through conduit 166 and fed to conduit 169 for delivery to the bottom of tank 170.

The data in the following Table 1 illustrates operating conditions for a system according to FIG. 3 of the drawings using water as the peak shaving cooling liquid. The steam condenser is designed for a maximum of 82° F. ambient air operation. The data pertains to operation at ambient air temperature conditions of 95° F., 82° F. and 70° F. Plant design load is 365 MW; design heat rejection rate is $1.9\times10^9$ Btu/Hr.

During the regeneration mode the boiler feed temperature (161° F.) 136,82 is 28° F. higher than that of the water (133° F.) removed from steam box 72 by conduit 74 which would otherwise be fed to the boiler. By feeding the hot water directly to the boiler, an energy saving at the boiler of $40\times10^6$ BTU/hr. is obtained. Furthermore, the flow rate at pump 76 is about 20% less, thus reducing the pump requirement by 62 HP, than required when the water is fed cold to the boiler.

TABLE 1

| FIG. 4 NO. | 82 | 16 | 17 | 22 | 23 | 70 |
|---|---|---|---|---|---|---|
| System Operating With 100% Load at Ambient 95° F. (Peak Shaving Mode) | | | | | | |
| TEMP. (°F.) | 161 | 161 | 161 | 95 | 137 | 161 |
| PRESSURE (PSIA) | 40 | 10" HgA | 10" HgA | 14.6 | 14.6 | 10" HgA |
| FLOW/$10^6$ (lb/hr) | 1.88 | 1.88 | 1.59 | 161 | 161 | 1.59 |
| FLUID | Water | Water Vapor | Water Vapor | Air | Air | Water |
| System Operating With 100% Load at Ambient 82° F. (Normal Operation) | | | | | | |
| TEMP. (°F.) | 159 | 159 | 159 | 82 | 131 | 159 |
| PRESSURE (PSIA) | 40 | 9.55" HgA | 9.55" HgA | 14.6 | 14.6 | 9.55" HgA |
| FLOW/$10^6$ (lb/hr) | 1.88 | 1.88 | 1.88 | 164 | 164 | 1.88 |
| FLUID | Water | Water Vapor | Water Vapor | Air | Air | Water |
| System Operating with 75% Load at Ambient 70° F. (Cooling Regeneration Mode) | | | | | | |
| TEMP. (°F.) | 161 | 133 | 133 | 70 | 108 | 133 |
| PRESSURE (PSIA) | 40 | 4.97" HgA | 4.97" HgA | 14.6 | 14.6 | 4.97" HgA |
| FLOW/$10^6$ (lb/hr) | 1.41 | 1.41 | 1.52 | 168 | 168 | 1.52 |
| FLUID | Water | Water Vapor | Water Vapor | Air | Air | Water |

| FIG. 4 NO. | 74 | 94 | 102 | 110 | 120 | 119 | 126 | 144 | 136 |
|---|---|---|---|---|---|---|---|---|---|
| System Operating With 100% Load at Ambient 95° F. (Peak Shaving Mode) | | | | | | | | | |
| TEMP. (°F.) | 161 | 110 | 110 | 161 | 161 | — | — | — | — |
| PRESSURE (PSIA) | 10" HgA | 35 | 35 | 40 | 20 | — | — | — | — |
| FLOW/$10^6$ (lb/hr) | 7.51 | 5.63 | 5.63 | 5.63 | 5.63 | — | — | — | — |
| FLUID | Water | Water | Water | Water | Water | — | — | — | — |
| System Operating With 100% Load at Ambient 82° F. (Normal Operation) | | | | | | | | | |
| TEMP. (°F.) | 159 | — | — | — | — | — | — | — | — |
| PRESSURE (PSIA) | 9.55" HgA | — | — | — | — | — | — | — | — |
| FLOW/$10^6$ (lb/hr) | 1.88 | — | — | — | — | — | — | — | — |
| FLUID | Water | — | — | — | — | — | — | — | — |
| System Operating with 75% Load at Ambient 70° F. (Cooling Regeneration Mode) | | | | | | | | | |
| TEMP. (°F.) | 133 | — | 161 | 161 | — | 110 | 161 | 33 | 161 |
| PRESSURE (PSIA) | 4.97" HgA | — | 35 | 40 | — | 35 | 14.7 | 40 | 40 |
| FLOW/$10^6$ (lb/hr) | 5.40 | — | 3.99 | 1.41 | — | 5.40 | 5.40 | 5.40 | 1.41 |
| FLUID | Water | — | Water | Water | — | Water | Water | Water | Water |

What is claimed is:

1. A method of operating a steam driven turbine comprising:

conveying a stream of the exhaust steam from the turbine to a primary cooling means to condense the steam and feeding the resulting condensate to a boiler for conversion to steam to drive the turbine so long as the heat rejection capacity of the primary cooling means is adequate to condense all of the steam;

supplementing the cooling capacity of the primary cooling means, when it provides inadequate cooling to condense all of the steam, by peak shaving cooling by contemporaneously also withdrawing boiler quality cold cooling water from a cold water reservoir and feeding the cold cooling water into the exhaust steam to thereby condense a sufficient portion of the steam to water such that the remaining portion of the steam is condensed to water by the primary cooling means;

feeding part of the hot condensed water, from the primary cooling and the peak shaving cooling, directly to the boiler used to produce the steam which drives the turbine, and part of the hot condensed water to a hot water reservoir, during such times as the cooling capacity of the primary cooling means is supplemented as described; and when the cooling capacity of the primary cooling means has excess cooling capacity to condense steam, feeding cold condensed water from the primary cooling means to the cold water reservoir, and withdrawing hot water from the hot water reservoir and feeding it hot to the boiler.

2. A method according to claim 1 in which the primary cooling means condenses the steam by heat rejection to ambient air in an air cooled steam condenser or cooling tower.

3. A method according to claim 1 in which, when the primary cooling means has excess cooling capacity, hot water is withdrawn from the hot water reservoir and fed directly into the exhaust steam thereby flashing some of the water and cooling the rest, and withdrawing the cold water and feeding it to the cold water reservoir.

4. Apparatus comprising a steam driven turbine;

means for conveying a stream of exhaust steam from the turbine to a primary cooling means to condense the steam;

means for feeding the condensate to a boiler for conversion to steam to drive the turbine so long as the heat rejection capacity of the primary cooling means is adequate to condense the steam;

means for supplementing the cooling capacity of the primary cooling means, when it provides inadequate cooling to condense the steam, by peak shaving cooling, including means for contemporaneously also withdrawing boiler quality cold cooling water from a cold water reservoir and feeding the cooling water into the exhaust steam to thereby condense a sufficient portion of the steam to water such that the remaining portion of the steam is condensed to water by the primary cooling means;

means for feeding part of the hot condensed water, from the primary cooling and the peak shaving cooling, directly to the boiler, used to produce the steam which drives the turbine, and part of the hot condensed water to a hot water reservoir, during such times as the cooling capacity of the primary cooling means is supplemented as described; and means for feeding cold condensed water from the primary cooling means to the cold water reservoir, and withdrawing hot water from the hot water reservoir and feeding it hot to the boiler, when the cooling capacity of the primary cooling means has excess cooling capacity to condense steam.

5. Apparatus according to claim 4 in which the primary cooling means includes an air cooled steam condenser or cooling tower in which steam is condensed by heat rejection to ambient air.

6. Apparatus according to claim 4 in which the primary cooling means includes a closed loop refrigeration cycle.

* * * * *

UNITED STATES PATENT AND TRADEMARK OFFICE

CERTIFICATE OF CORRECTION

PATENT NO. : 4,449,368

DATED : May 22, 1984

INVENTOR(S) : TIMOTHY JOHN HAYNIE

It is certified that error appears in the above-identified patent and that said Letters Patent are hereby corrected as shown below:

Column 8, line 54, change "33" to --133--.

Signed and Sealed this

Second Day of October 1984

[SEAL]

*Attest:*

GERALD J. MOSSINGHOFF

*Attesting Officer*

*Commissioner of Patents and Trademarks*